United States Patent [19]

Berry

[11] 3,983,735

[45] Oct. 5, 1976

[54] CLEAT FORMING METHOD AND MACHINE

[76] Inventor: Robert N. Berry, 4214 Newland, Cedar Falls, Iowa 50613

[22] Filed: Mar. 21, 1975

[21] Appl. No.: 560,773

[52] U.S. Cl. ..... 72/312; 72/319; 72/320; 72/379

[51] Int. Cl.[2] ..... B21B 25/04; B21C 37/02

[58] Field of Search ..... 52/218, 220, 244; 138/156, 157, 162, 163, 165, 166, 168, 169, 178, 128, DIG. 4, DIG. 8, DIG. 10, DIG. 11; 72/324, 326, 329, 330, 331, 332, 333, 335, 336, 337, 339, 379, 312, 316, 319, 320; 29/200 B

[56] References Cited

UNITED STATES PATENTS

| | | | |
|---|---|---|---|
| 1,194,602 | 8/1916 | Curtis | 72/312 |
| 2,722,858 | 11/1955 | Oyen | 72/312 X |
| 2,963,066 | 12/1960 | Nelson | 72/312 X |
| 3,875,784 | 4/1975 | Daniels | 72/312 X |

*Primary Examiner*—Leon Gilden

*Attorney, Agent, or Firm*—Zarley, McKee, Thomte & Voorhees

[57] ABSTRACT

The method of fabricating the sheet metal duct units of the present invention comprises cutting a plurality of spaced lines of notches in an elongated strip of sheet metal, each of the lines being transverse to the longitudinal axis of the strip. The strip is sheared at predetermined points along the length thereof so that the cutting and the shearing operation combine to form sheet metal segments each having at least one cleat tab on at least one end thereof. Next the sheet metal segments are bent along at least one axis extending longitudinally with respect to the longitudinal axis of the sheet metal so as to form an upstanding leg, the cleat tab being on one end of the upstanding leg. The cleat tab is then bent back against the remainder of the upstanding leg so as to form a cleat.

The apparatus for accomplishing the above process comprises a straight line assembly including a notching means for forming notches in predetermined points across the width of the strip, shearing means for shearing the strip into segments of predetermined length; roll former RB means for forming the upstanding leg and for forming additional folds along a line parallel to the longitudinal axis of the strip; and cleat forming means positioned adjacent the roll press means for receiving the folded sheet elements therefrom and for engaging and bending the end edges of the upstanding leg to form a cleat.

10 Claims, 14 Drawing Figures

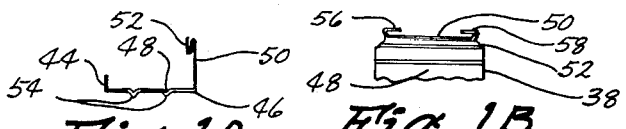
Fig. 1A
Fig. 1B
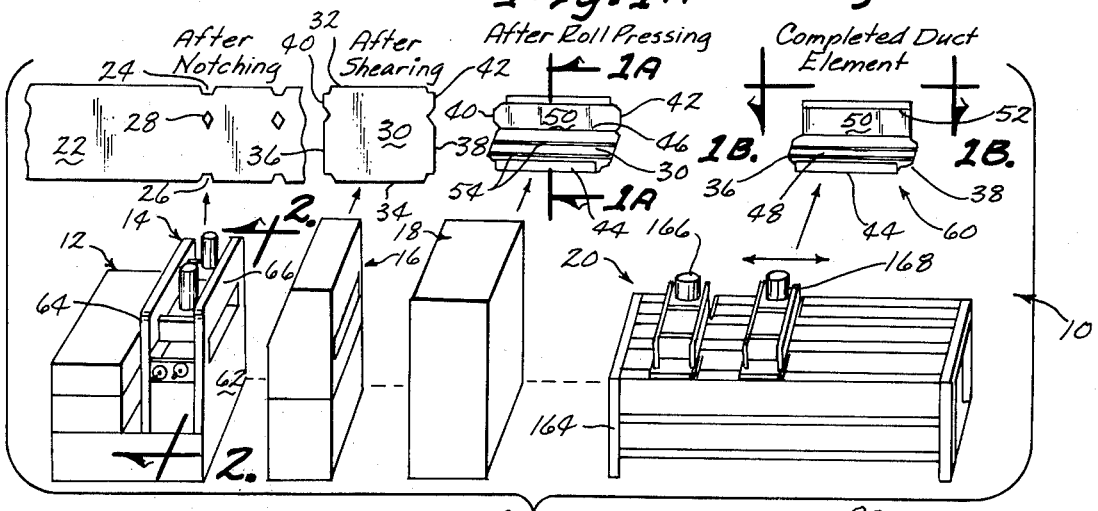
Fig. 1
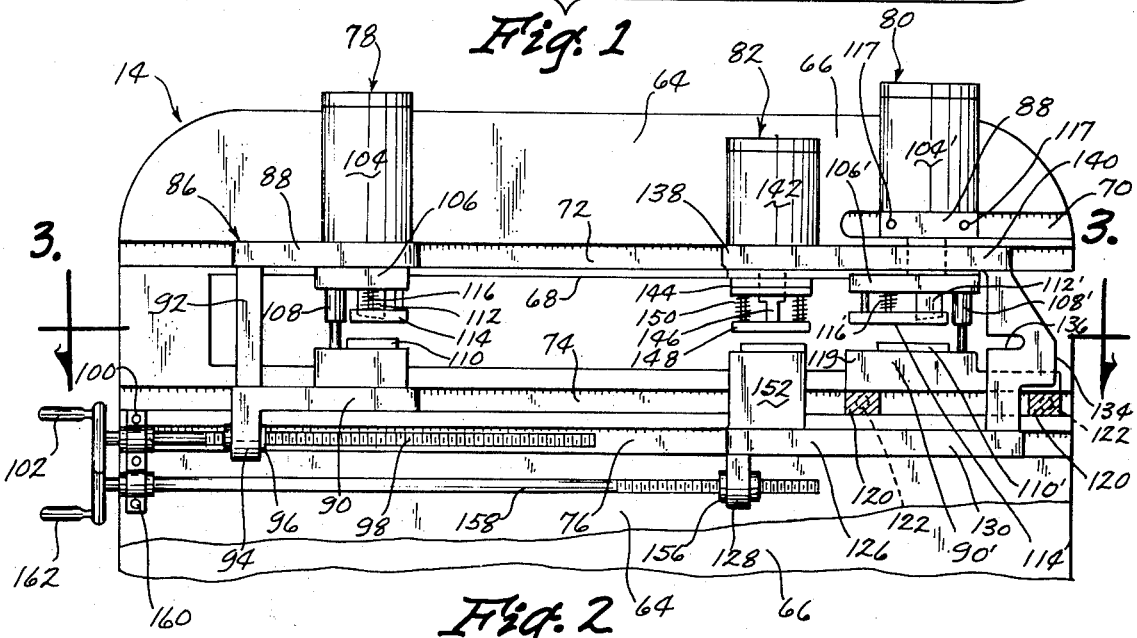
Fig. 2
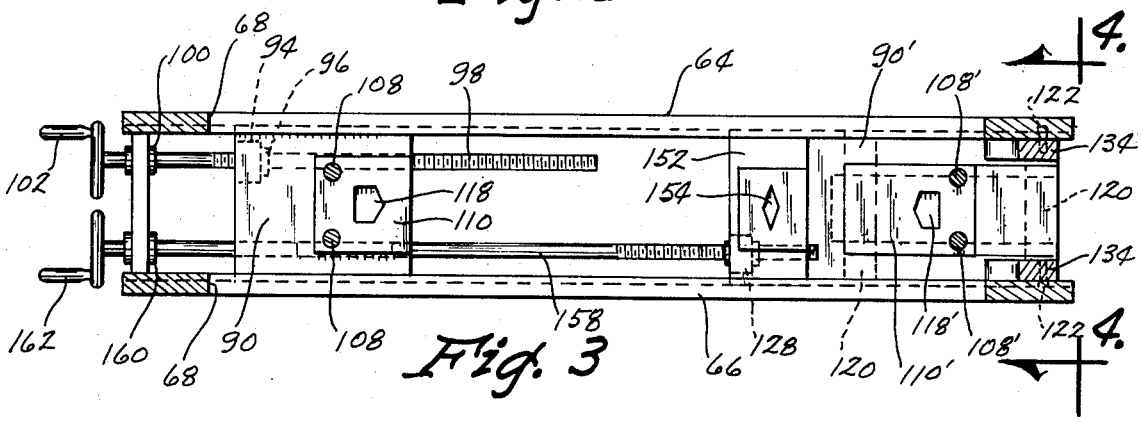
Fig. 3

CLEAT FORMING METHOD AND MACHINE

BRIEF SUMMARY OF THE INVENTION

This invention relates to a method and means for forming completed duct elements from an elongated continuous sheet of sheet metal.

Sheet metal workers working in construction project form sheet metal air conditioning and heat ducts from L-shaped duct elements such as shown in FIGS. 1, 1*a* 1*b* of the drawings. Two L-shaped elements are placed together in mating engagement to form a rectangular duct segment of predetermined length. The various segments are then fastened together by cleats on the end edges of the duct segments.

The L-shaped duct elements are manufactured, boxed and shipped to the construction site where sheet metal workers assemble them. Previous machinery for forming the L-shaped duct elements has been bulky, cumbersome, and inefficient. The machinery includes a plurality of notching, shearing and roll form RB machines which are arranged in an L-shaped or U-shaped configuration. The sheet metal is not acted upon in a straight line, but is moved first longitudinally, and then sideways for several operations. Because the process is not in a straight line, there are considerable limitations as to the size and shape of duct work that can be formed by present devices.

The present invention includes an assembly line which is arranged in a straight line. The assembly line includes a notching machine, a shearing machine, a roll former RB, and a cleat forming machine, all arranged in a straight line. Because the sheet metal is acted upon in a straight continuous line, there is considerable flexibility in determining the length, width, and height of the completed L-shaped duct element.

Therefore, a primary object of the present invention is the provision of a method and means for forming sheet metal duct work in a continuous straight line manufacturing process.

A further object of the present invention is the provision of a method and means which permits formation of duct components having varying lengths, widths and heights.

A further object of the present invention is the provision of a method and means for forming duct elements which requires less floor space of manufacturing plants than previous prior art methods and machines for doing the same operation.

A further object of the present invention is the provision of a method which eliminates several steps from previous methods for forming duct elements.

A further object of the present invention is the provision of a method and means which increases the speed at which the duct work can be formed.

A further object of the present invention is the provision of a method and means which requires less equipment to do the same operation previously done by prior art devices.

A further object of the present invention is the provision of a notching machine which permits notching to be performed on a continuous elongated strip of sheet metal.

A further object of the present invention is the provision of a notching machine which permits lateral adjustment of the location of notch presses with respect to the width of the sheet metal so as to form duct work of varying sizes.

A further object of the present invention is the provision of a notching machine which includes two edge notchers and a middle notcher therebetween, the middle notcher being laterally movable with respect to the sheet metal while at the same time permitting the sheet metal to pass therethrough.

A further object of the present invention is the provision of a notching machine wherein the middle notch includes a press and a die which are interconnected and are laterally movable in unison while at the same time permitting the sheet metal to pass continuously therethrough.

A further object of the present invention is the provision of a cleat forming machine which will form cleats on duct segments of any length.

A further object of the present invention is the provision of a cleat forming machine which can form cleats at both ends of a segment of duct work simultaneously.

A further object of the present invention is the provision of a cleat forming machine which can receive duct work in a straight line from a notching, shearing and roll pressing assembly line.

BRIEF DESCRIPTION OF THE SEVERAL VIEWS OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

FIG. 1 is a perspective view of the assembly line of the present invention and also showing the sheet metal in various stages of manufacture;

FIG. 1*a* and FIG. 1*b* are sectional views taken along lines 1*a* and 1*b* respectively of FIG. 1;

FIG. 2 is a sectional view taken aong line 2—2 of FIG. 1;

FIG. 3 is a sectional view taken along line 3—3 of FIG. 2;

DETAILED DESCRIPTION

Figure 4:
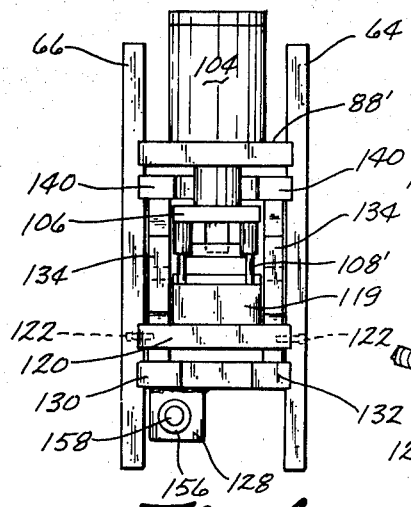
FIG. 4 is an end view taken along line 4—4 of FIG. 3.
Figure 5:
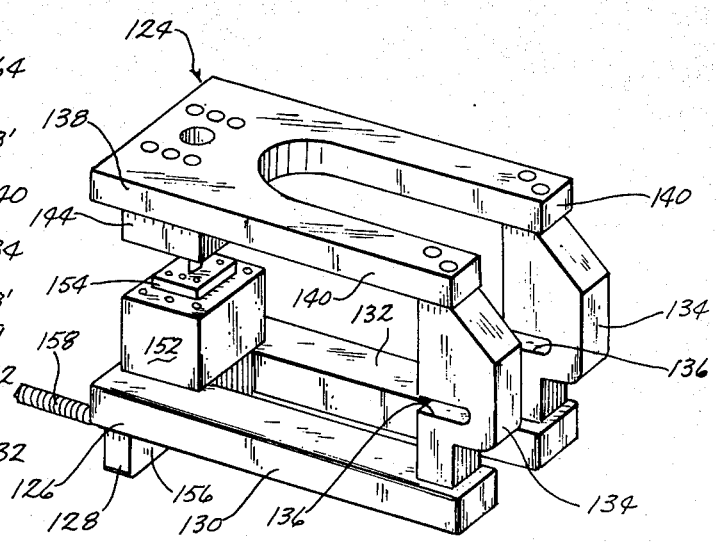
FIG. 5 is a perspective view of the middle slide of the notching machine.

Referring to FIG. 1 the straight line assembly line is designated by the numeral 10. It comprises a driving or feeding machine 12, a notching machine 14, a shearing machine 16, a roll form RB machine 18 (shown only schematically as a block), and a cleat forming machine 20. FIG. 1 also illustrates thhe form of the sheet metal in the various stages of manufacture. The sheet metal is shown in an elongated strip 22. It is acted upon by feeding machine 12 and fed into notching machine 14. Notching machine 14 forms three notches including two lateral notches 24, 26 and an intermediate diamond-shaped notch 28. Notches 24, 26 are trapezoidal in shape with the bases of the trapezoids being open and facing outwardly from the lateral edges of strip 22. Notches 24, 26 and 28 are in a straight line extending transversely of the longitudinal axis of strip 22. A plurality of lines of notches such as previously described are formed at predetermined distances apart along the length of strip 22. The distance between each line of notches is determined by feeding machine 12 which stops the moving strip at predetermined time intervals in order to permit the notching machine to form the notches.

After being notched, the strip moves to shearing machine 16 which is a conventional knife-like shearing device adapted to shear the strip into segments of predetermined lengths such as designated by segment 30 in the drawings. Segment 30 is formed by shearing along a line which bisects the notches 24, 26 and 28. Thus a plurality of notches are formed in the edges of segment 30 in the following manner. A half of a trapezoid is formed at each of the four corners of the segment. On each end of the segment a half diamond notch is formed which derives from the diamond notch 28. The various notches in segment 30 form tabs which for reference purposes will be identified as follows: Upper edge tab 32, lower edge tab 34, long end tabs 36, 38 and short end tabs 40, 42.

From shearing machine 16, segments 30 pass to roll form RB machine 18 where they are formed with a plurality of longitudinal folds as follows: Lower edge tab 34 is folded upwardly to a vertical position to form a shoort upstanding leg 44 (FIG. 1*a*). A fold is made in a line between the apices of the two half diamond notches to form a corner 46 between a horizontal leg 48 and an upstanding leg 50. Tab 32 is formed into an S-shaped fold 52. Also one or more longitudinal beads 54 are formed to lend reinforcement to the completed duct element.

From roll form RB machine 18, segment 30 passes into the cleat forming machine 20. Cleat forming machine 20 forms a pair of cleats 56, 58 from tabs 40, 42 which are on the opposite ends of upstanding leg 50. The completed duct element is shown at the right hand side of FIG. 1 and is designated by the numeral 60.

Notching machine 14 comprises a frame structure 62 (FIG.1) having a pair of upstanding forward and rear frame plates 64, 66. The structure of notching machine 16 is shown in more detail in FIGS. 2 through 5. In FIG. 2 rear frame plate 66 is shown partially cut away to illustrate the components located between frame plate 64, 66. Each frame plate is provided wit a horizontally disposed rectangular window 68 through which the sheet metal passes as it is being acted upon by the notching machine 14. Formed on the inner facing sides of plates, 64, 66 are four groove-like tracks including first, second, third and fourth tracks 70, 72, 74, 76. First tract 70 is shorter than the remaining tracks and extends only a partial distance across the width of plate 64. Second track 72 is positioned above window 68 and extends the entire width of plates 64, 66. Third and fourth tracks 74, 76 are positioned below window 68 and extend the entire width of plates 64, 66.

Three notchers are mounted between plates 64, 66 and include a movable end notcher 78, a fixed end notcher 80, and a movable diamond notcher 82. Movable end notcher 78 is mounted for sliding movement in tracks 72, 74 by means of a slide frame 86. Slide frame 86 comprises upper and lower plates 88, 90 interconnected by a pair of vertical bars 92. Upper and lower plates 88, 90 are slidably retained within tracks 72, 74 respectively so as to permit frame 86 to slide across the width of plates 64, 66. Plate 90 has a downwardly extending flange 94 which includes a bearing 96 adapted to engage a threaded adjusting rod 98 which is also rotatably journaled at 100 to frame structure 62. Rotation of shaft 98 causes lateral movement of slide frame 86. Rotation of rod 98 may be accomplished by means of a crank handle 102, or this rotation may also be accomplished by virtue of other driving means connected to computers or digital equipment for automatic programmed adjustment of the position of slide frame 86.

Mounted to upper plate 88 of slide frame 86 is a pneumatic power means 104. While this is described herein as being a pneumatic power means, hydraulic cylinders and the like may also be used without detracting from the invention. Power means 104 drives a vertically reciprocating ram 106. Ram 106 includes a downwardly extending telescopic member 108 which is connected at its lower end to a die block 110. Telescoping member 108 is adapted to telescope inwardly and outwardly as ram 106 reciprocates upwardly and downwardly with respect to die block 110. Thus member 108 holds ram 106 and die block 110 in predetermined vertical registered alignment with respect to one another. Fixed to ram 106 for movement in unison therewith is a punch 112 which is trapezoidal in cross section. A wiper plate 114 is slidably mounted around punch 112 and is spring mounted with respect to ram 106 by a spring 116. Die block 110 is provided with a die opening 118 (FIG. 3) which conforms to the cross sectional configuration of punch 112.

In operation movable notcher 78 is positioned so that the outer edge of punch 112 coincides with the lateral edge of sheet metal strip 22 as it passes through window 68. Driving machine 12 stops sheet metal strip 22 and notcher 76 is actuated. Upon actuation power means 104 causes ram 106 and punch 112 to descend downwardly to engage the upper surface of sheet 22 and to pierce sheet 22 thereby forming the trapezoidal notch designated by 26 in FIG. 1. Upon engaging sheet metal strip 22, lost motion occurs between wiper plate 114 and punch 112 so that punch 112 continues downward movement whereas wiper plate 114 depresses spring 116 and remains stationary. Upon upward movement of punch 112, the bias provided by spring 116 causes wiper plate 114 to wipe the punched sheet metal 22 from punch 112 as it is drawn upwardly.

Fixed end notcher 80 is nearly identical on construction to movable notcher 78, and the corresponding parts are indicated by the same numerals with prime marks. Notcher 80 includes several features which are slightly different from notcher 78. Upper plate 88' is mounted in first track 70 rather than in track 72 as is the case with plate 88 of notcher 78. Furthermore, upper plate member 88' is fixed in a predetermined position by means of locking bolts or rivets 114. Die block 110' is mounted to an elongated plate 119 which in turn is supported at its opposite ends by a pair of cross bars 120. Cross bars 120 have their opposite ends retained within third track 74 and are held rigidly therein by means of locking bolts or rivets 122. Fixed end notcher 80 is adapted to operate simultaneously with movable notcher 78 to provide trapezoidal notches 24, 26 on the opposite edges of sheet 22.

Diamond notcher 82 is slidably mounted in tracks 72, 76 by a sliding frame designated generally by the numeral 124. Frame 124 is shown in perspective in FIG. 5 and includes a lower slide member 126 which has a downwardly extending flange 128 and which includes two laterally extending spaced apart arms 130, 132. Lower slide memeber 126 has its opposite lateral edges slidably mounted in track 76.

Secured to the rearward ends of arms 130, 132 are a pair of upwardly extending connecting plates 134. Intermediate the opposite ends of connecting plates 134 are a pair of horizontal grooves 136 which are adapted to receive the lateral edges of sheet metal strip 22 as it passes through window 68. The upper ends of connecting plates 134 are rigidly connected to an upper slide member 138 which is similar in construction to lower slide member 126 and which includes laterally extending arms 140. Arms 140 are spaced apart so as to permit pneumatic power means 104' of fixed end notcher 80 to extend downwardly therebetween.

Mounted to upper slide member 138 is a power means 142 which is adapted to drive a ram 144 upwardly and downwardly in reciprocated movement. Ram 144 is a diamond-shaped punch 146 which extends through a wiper plate 148. Wiper plate 148 is movably mounted to ram 144 and is biased apart from ram 144 by means of springs 150.

Mounted to lower slide member 126 in registered alignment below punch 146 is a die block 152 having a diamond-shaped die 154 (FIG. 3) for receiving punch 146.

Threadably mounted in a bearing 156 within downwardly extending flange 128 is an adjustment rod 158 which is also journaled at 160 to frame structure 62. Rotation of rod 158 may be accomplished by means of a crank handle 162 so as to cause movement of diamond notcher 82 laterally across the width of window 68.

The structure of sliding frame 124 permits lateral adjustment of diamond notcher 82 without interfering with the movement of sheet 22 through window 68 and also without interfering with the operation of fixed end notcher 80. Horizontal grooves 136 permit notcher 82 to be moved laterally without engaging strip 22. Referring to FIG. 2, notcher 82 can move left to a position wherein connecting plates 134 engage the left cross bar 120, and can move to the right until plates 134 engage the right cross bar 120. This feature is important to the present invention inasmuch as it permits strip 22 to be processed in a straight line method rather than in methods presently used. Strip 22 is processed continually in a continuous straight line without having to be moved laterally as in present devices. The ability to adjust notches 82 laterally permits the diamond 28 to be formed in a plurality of configurations which will vary the dimensions of the completed duct element 60.

The punching operation of notching members 78, 80 and 82 is substantially the same with punches 112, 112' and 146 piercing strip 22 to form notches 24, 26 and 28 respectively. Spaced legs 140 of upper slide member 138 also provide space for fixed end notcher 80 to extend downwardly therebetween so as to punch the lateral edge of strip 22.

Shearing machine 16 receives the notches strip 22 from notching machine 14 and severs the strip 22 into segments 30. Such shearing machines are known in the art, and therefore the particular structure of shearing machine 16 will not be described herein other than to say that it functions to sever strip 22 along a line which bisects notches 24, 26 and 28.

Roll form RB machine 18 receives the segments 30 from shearing machine 16. An example of a commerically available machine for this roll form RB operation is a roll form RB machine manufactured and sold by Flaglar Corporation, 7600 Iowa Avenue, Detroit, Mich. 48212, under the trademark "Roll-A-Duct."

Roll form RB machine 18 forms segment 30 into the form shown in FIG. 1 under the legend "after roll forming RB." All that remains to be done to complete the duct element is to form cleats 56, 58 from short tabs 40, 42 at the opposite ends of upstanding leg 50. This cleat forming action is accomplished by cleat forming machine 20.

Cleat forming machine 20 includes a table-like frame 164. Mounted on the upper surface of table 164 are a pair of cleat formers 166, 168. Cleat former 166 is fixed to frame 164, and cleat former 168 is movably mounted thereon.

Figure 6:
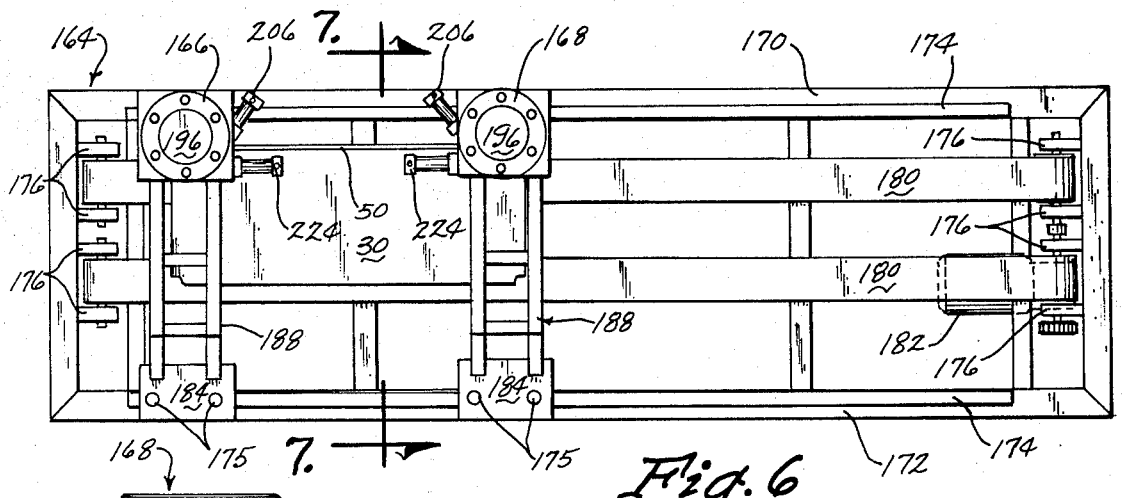
FIG. 6 is a plan view of the cleat forming machine.
Figure 7:
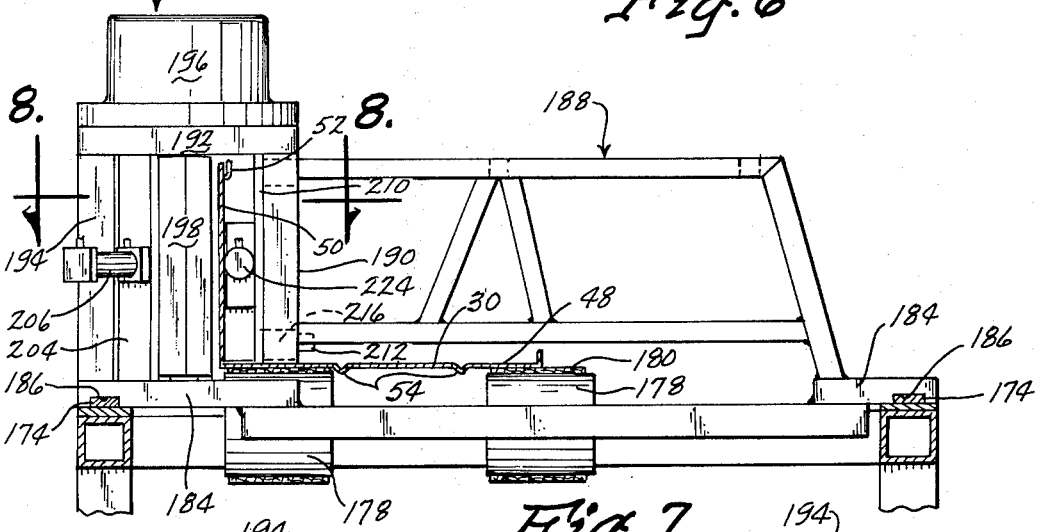
FIG. 7 is a sectional view taken along line 7—7 of FIG. 6.

Referring to FIG. 6, frame 164 includes two lateral upper frame members 170, 172 which are horizontal and parallel to one another. A pair of spaced apart rails 174 are rigidly mounted to the upper surfaces of frame members 170, 172. At each end of frame 164 are mounted a plurality of pillow blocks 176 for rotatably mounting belt drums 178 (FIG. 7). A pair of parallel spaced apart conveyor belts 180 are trained around drums 178 and are adapted to carry sheet metal segment 30 across the upper surface of frame 164. A motor 182 is drivingly connected to drum 178 so as to drive belts 180.

Figure 8:
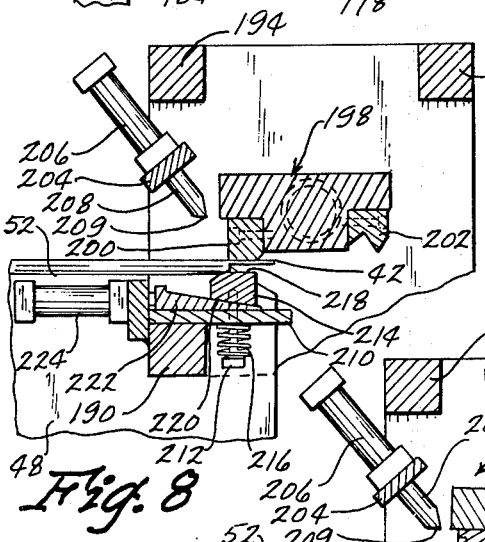
FIG. 8 is a sectional view taken along line 8—8 of FIG. 7.
Figure 9:
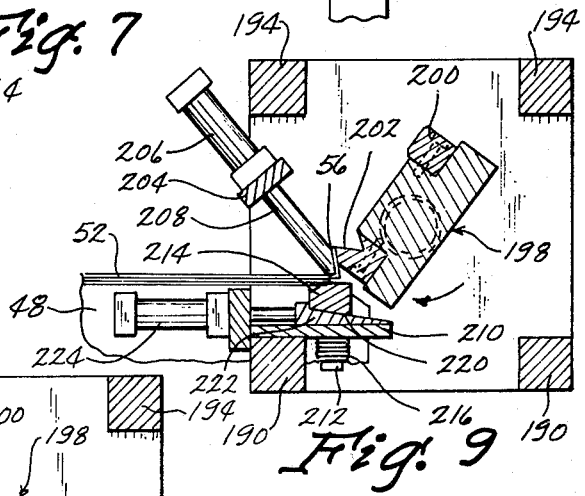
FIGS. 9 and 10 are views similar to FIG. 8 showing the various positions of the components therein.
Figure 10:
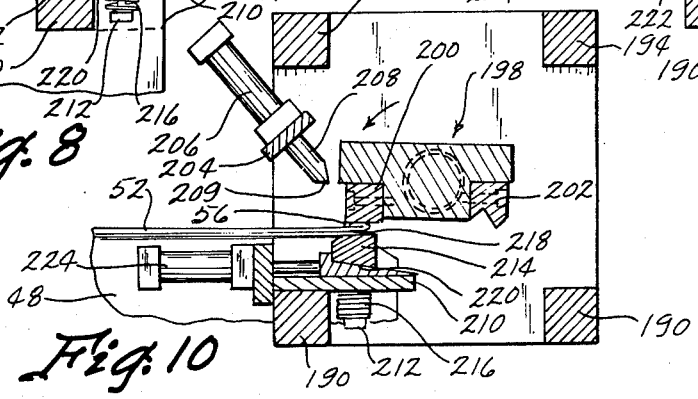

Cleat formers 166, 168 are slidably mounted on rails 174, although cleat former 166 is normally held in a stationary position whereas cleat former 168 is movable along rails 174 to permit adjustment for the varying lengths of segments 30. Suitable locking means may be provided such as bolts 175 for selectively locking cleat formers 166, 168 against sliding movement. The structure of cleat formers 166, 168 is substantially the same, and therefore the same numerals will be used to identify the corresponding parts of each of the two cleat formers. A pair of base plates 184 include grooves 186 which are slidably mounted over rails 174. Rigidly secured to the right hand base plate 184 (as viewed in FIG. 6) is a spanning frame 188 which extends upwardly and across conveyor belts 180. A pair of vertical members 190 are connected to the opposite end of spanning frame 188. Frame members 190 include lower ends which terminate in spaced relation above conveyor belt 180. The upper ends of vertical members 90 are rigidly secured to a top plate 192. Top plate 192 is supported by a pair of vertical legs 194 which are rigidly secured at their lower ends to the left hand base plate 184. Mounted above top plate 192 is a hydraulic actuator 196 which is drivingly connected to a forming ram 198 which is rotatably mounted below to plate 192 for pivotal movement about a vertical axis. Referring to FIGS. 8–10, forming ram 198 has rigidly attached thereto a crimp blade 200 and a wipe blade 202.

Extending vertically between base plate 184 and top plate 192 is a clamp ram support member 204 to which is rigidly connected a clamp ram hydraulic cylinder 206. Drivingly connected to cylinder 206 is a clamp ram 208 having an apex 209 on its distal end.

An additional vertical plate 210 is rigidly secured to one of the two vertical members 190. A spring mounted bolt 212 extends through plate 210 and is connected to a vertically disposed form block 214. A spring 216 urges bolt 212 downwardly as viewed in FIGS. 7–9 so as to urge block 214 towards vertical plate 210. Form block 214 includes a clamp surface 218 and an inclined surface 220. Interposed between inclined surface 220 and vertical plate 210 is a wedge block 222 which is drivingly connected to a wedge block cylinder 224. Extension of cylinder 224 causes extension of wedge block 222 so as to cam form block 214 away from plate 210 against the bias of spring 216. Retraction of wedge block 222 permits form block 214 to be moved towards plate 210 by the spring bias of spring 216.

In operation, conveyor belts 180 carry duct segment 30 to the position shown in FIGS. 7–10. Tab 42 is positioned adjacent form block 214 as illustrated in FIG. 8. A stop means (not shown) engages segment 30 to hold it against longitudinal movement beyond the position shown in FIG. 8. The first movement which takes place is the extension of wedge block 222 so as to casue form block 214 to move towards tab 42 to an extended position as shown in FIG. 8. The second motion which takes place is the extension of cylinder 206 so as to cause clamp ram 208 to extend into engagement with the back side of tab 42 also as shown in FIG. 8. The third motion which takes place is a clockwise rotation of forming ram 198 so that wipe blade 202 engages tab 42 and folds tab 42 back against clamp ram 208. At this point in time the various components are in the position shown in FIG. 9. Tab 42 has been folded slightly over center so as to begin forming cleat 56. Forming ram 198 then stops rotating and cylinder 206 retracts clamp ram 208. Forming ram 198 then commences rotating in a counter clockwise direction to the position shown in FIG. 10 wherein crimping blade 200 engages cleat 56 and folds it to the completed position such as shown in FIG. 10. Forming block 214 supports upstanding leg 50 during this final crimping action. Cylinder 224 then retracts wedge block 222 so as to permit form block 214 to be retracted away from upstanding leg 50. At this point in time, all the components have returned to the position shown in FIG. 8. Duct segment 30 is then completed and is released so as to permit it to be carried away by conveyor belts 180.

Figure 11:
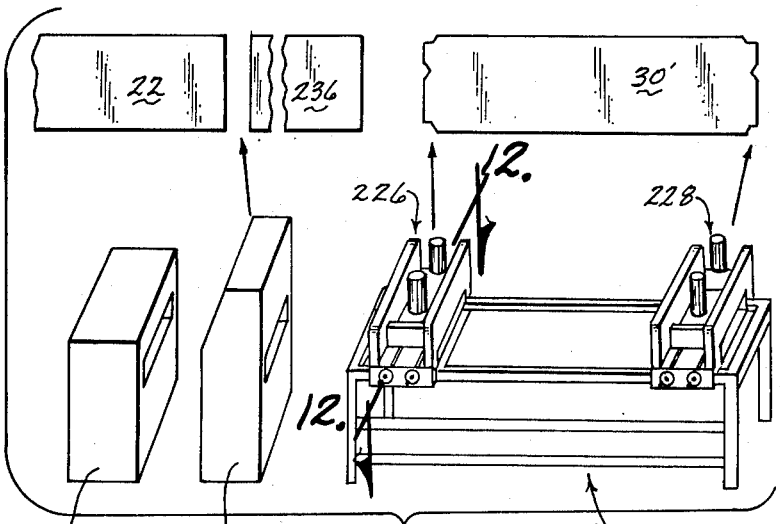
FIG. 11 is a perspective view showing a modified form of the notching machine.
Figure 12:
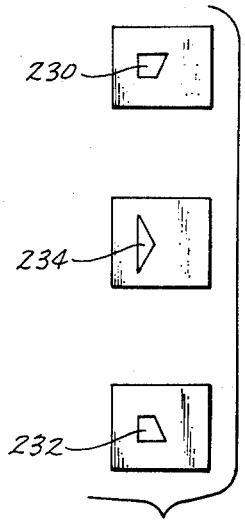
FIG. 12 is a sectional view taken along line 12—12 of FIG. 11.

A modified form 225 of the notching machine is shown in FIG. 10. The particular notching machine shown in this figure includes two notching frames 226 and 228, each of which is identical in construction with notching machine 14 with the exception that the punches and dies in machines 226, 228 form half trapezoids and half diamonds rather than complete trapezoids and complete diamonds such as done by notching machine 16. The dies of machines 226, 228 are shown in FIG. 11 and include half trapezoid dies 230, 232 and half diamond dies 234.

Shearing machine 16 is placed in front of notching machine 225 and severs metal strip 22 into a rectangular segment 236 prior to notching. Segment 236 is then positioned between notches 226, 228 with notchers 226, 228 registered above the end edges of segment 236. Notchers 226, 228 are actuated to form half trapezoid and half diamond notches at the end edges of segment 236. The resulting product is a segment 30' which is identical to segment 30 shown in FIG. 1.

The apparatus described herein permits duct element 60 to be formed in a continuous straight line process. The total assembly requires less floor space than in previous devices, and eliminates several steps from previous methods particularly those requiring sidewise movement of the element.

Considerable flexibility is permitted in the ability to change the dimensions of the completed duct. The width can be varied by sliding movable notcher 78 to accommodate various widths of sheet metal. The height of leg 50 can be varied by sliding diamond notcher 82 trasversely of sheet 22 to locate diamond notch 28 at the desired position. The possible length of duct element is virtually unlimited, a feature not found in prior art devices. Thus it can be seen that the device accomplishes at least all of its stated objectives.

I claim:

1. A cleat forming machine for folding a cleat at the end of a vertically disposed sheet member having opposite faces, said cleat forming machine comprising:

support means having a supporting surface for supporting said sheet member in a predetermined upstanding position;

an elongated upstanding form block mounted on said support means for movement from a retracted position spaced from one face of said sheet member to an extended position adjacent said one face of said sheet member;

a clamp ram mounted on said support means for movement from a retracted position spaced from the opposite face of said sheet member to an extended position in engagement with said sheet member a predetermined distance inwardly from one end of said sheet member, said clamp ram and said form block embracing said sheet member therebetween when said sheet member is in said predetermined position and said ram and block are in their respective extended positions, a forming ram rotatably mounted on said support means for rotation about an upstanding axis, said forming ram having a wipe blade for engaging said one end of said sheet member and folding said one end of said sheet member back against said clamp ram whenever said forming ram rotates in one direction, said forming ram having a crimp blade for engaging said folded portion of said sheet member and crimping said folded portion towards said form block whenever said forming ram rotates in the direction opposite from said one direction; and power means for moving said clamp ram, form block, and forming ram.

2. A machine according to claim 1 wherein said clamp ram includes an apex for engaging said sheet member to cause a vertical crease in said sheet member when said wipe blade folds said one end of said sheet member against said clamp ram.

3. A machine according to claim 1 wherein said form block is movable perpendicularly to said sheet member, said clamp ram is movable obliquely to said sheet member on the opposite side thereof.

4. A machine according to claim 1 wherein said form block is movably mounted to a support plate on said support means; bias means urging said form block to said retracted position; a wedge block engaging said form block and being movable to cam said form block to said extended position against said bias means.

5. A machine according to claim 1 wherein said support means comprises a table having a top with lateral edges, and a spanning frame mounted thereon, said spanning frame having base plates engaging said lateral edges of said table top, said form block, clamp ram, and forming ram being adjacent one end of said spanning frame.

6. A machine according to claim 5 wherein said base plates of said spanning frame are slidable on said lateral edges of said table for sliding movement along the length of said table.

7. A machine according to claim 6 wherein conveying means are movable on said table top beneath said spanning frame for conveying said sheet member to and from said predetermined position.

8. A machine according to claim 7 wherein a second spanning frame identical to said first spanning frame is mounted on said table top said second spanning frame having a form block, clamp ram, and forming ram identical to said first mentioned form block, clamp ram, and forming block.

9. A method for forming a cleat on the end of an upstanding sheet member comprising:

positioning said sheet member between a form block and a clamp ram, said clamp ram having an apex engaging said sheet member at a point spaced inwardly from said one end;

rotating a forming ram in one direction to engage said one end and fold said one end back against said clamp ram; withdrawing said clamp ram from engagement with said sheet member;

rotating said forming ran in a direction opposite from said one direction to engage said one end and fold said one end further back against said sheet member while supporting said sheet member with said form block.

10. A method according to claim 9 wherein said sheet member is folded more than 90° when being folded against said clamp ram.

* * * * *